United States Patent [19]

Igisu

[11] 4,001,053

[45] Jan. 4, 1977

[54] METHOD OF REMOVING RESIDUAL STRESS OF A WORK FORMED OF METAL OR CERAMIC AND A SEALING APPARATUS

[75] Inventor: Taro Igisu, Fukuoka, Japan

[73] Assignee: EIM Electric Co., Ltd., Kita-Kyushu, Japan

[22] Filed: Nov. 2, 1973

[21] Appl. No.: 412,250

Related U.S. Application Data

[63] Continuation-in-part of Ser. No. 267,651, June 29, 1972, abandoned.

[30] Foreign Application Priority Data

Apr. 21, 1972 Japan ..... 47-40562
Dec. 5, 1972 Japan ..... 47-122207

[52] U.S. Cl. ..... 148/12.9; 29/DIG. 46; 72/DIG. 20; 264/340

[51] Int. Cl.[2] ..... C21D 1/04

[58] Field of Search ..... 148/12.9; 29/DIG. 46; 72/DIG. 20; 264/340

[56] References Cited

UNITED STATES PATENTS

| | | | |
|---|---|---|---|
| 3,323,340 | 6/1967 | Bitzer, Jr. | 148/12.9 |
| 3,346,932 | 10/1967 | Cheape, Jr. | 28/72 |
| 3,536,539 | 10/1970 | Turk et al. | 148/12.9 |

*Primary Examiner*—W. Stallard

[57] ABSTRACT

A method of removing residual stress of a work formed of metal or ceramic includes basically two separate treatments, a vibration treatment called percussion treatment and a heating treatment.

13 Claims, 16 Drawing Figures

METHOD OF REMOVING RESIDUAL STRESS OF A WORK FORMED OF METAL OR CERAMIC AND A SEALING APPARATUS

This application is a continuation-in-part of a pending application Ser. No. 267,651 filed on June 29, 1972, and now abandoned. And this invention relates to a method of removing residual stress of a work formed of metal or ceramic.

For removing residual stress of a work formed of metal or ceramic, especially metal, known are vibration method, heating method and in addition seasoning method.

The said vibration method is also called a forced vibration method, wherein a work is subject to forced vibration at (the same frequency with) the natural frequency thereof, that is, subject to resonance, whereby residual stress thereof is removed. In this method, vibration time is short. But the frequency of the vibrator must be tuned with the natural frequency of a work, and in some cases a work has a plurality of natural frequencies, so that a vibrator requires a complicated construction. Besides, according to this method, a work is vibrated after being fixed on a vibrator. Therefore it is necessary to change the said fixed portion of the work. If vibration is effected with only one portion fixed, residual stress is not removed in said portion, which is called a node.

Heating method includes annealing. The conventional annealing is performed, for example, at a temperature between 600° C and 800° C if a work is formed of steel. Residual stress thereof can be completely removed by annealing at such a temperature. But at such a high temperature the surface of a work is oxidized, and in addition more or less strain is left unremoved even after annealing, so that such annealing is not applicable to works which require fine finished surface. To avoid said disadvantages, a work must be annealed in a flow of hydrogen or in vacuum and subject to sub-zero treatment, which requires complicated operations.

Seasoning method, which is particularly applied for removing residual stress of castings, comprises exposing a work in the weather for some months, thus being unapplicable for rapidly removing residual stress, and not suitable for works of all kinds of materials. Further, another report denies the effect of this method for removing residual stress.

An object of the present invention is to provide a new method of removing residual stress of a work by eliminating the abovementioned disadvantages of the conventional methods.

Another object of the present invention is to provide a method of removing residual stress wherein residual stress can be, if not completely removed, made even through a work.

A further object of the present invention is to provide a method of removing residual stress applicable to a work of any shape such as a ring, a plate or the like.

A further object of the present invention is to provide a method of removing residual stress applicable to a work formed of cemented carbide, stainless steel, steel, other metals or ceramic.

A further object of the present invention is to provide a method of removing residual stress by vibrating a work at any frequency below the natural frequency of the work, thus being different from the conventional method in this respect.

A further object of the present invention is to provide a method of removing residual stress by heating at a temperature of about 200° C.

A further object of the present invention is to provide a method of removing residual stress caused by machining within a seal ring formed of cemented carbide or ceramic for mechanical sealing.

Other objects of the present invention will appear in the following description with reference to the appended drawings.

The method of removing residual stress according to the present invention can be divided generally into two treatments, that is, vibration treatment and heating treatment.

The vibration treatment of the present invention, being different from the conventional method which is called resonance method, is characterized in that a work is kept subject to free vibration for a time from a blow applied thereto to the next blow, thus affording to be called percussion treatment. In said treatment, vibration may be performed at any frequency below the natural frequency of a work to be vibrated. In this respect, this treatment is different from the conventional resonance method.

According to the percussion treatment of the present invention, a work is subject to forced vibration at any frequency belonging to a vibrator, but such forced vibration is not so important. More important is the free vibration to which the work is subject subsequently to said forced vibration. Said free vibration begins when the work is released from the vibrator, and continues till it touches the vibrator at the next time. That is, the forced vibration is necessary for causing the work to be subject to free vibration, and residual stress is removed from the work in the condition of free vibration. However, the frequency of the forced vibration has an influence upon the total cycles of the vibration applied on the work, as described below. Therefore, to make the most of the frequency of the forced vibration, it is necessary that the work is released from the vibrator and subject to free vibration when between one peak and the next peak of the forced vibration and then comes to contact again with the vibrator and is subject to forced vibration therewith. For example, if the work is released from the vibrator at a peak of a vibration, and comes to contact with the vibrator not at the next peak (that is, after 1 cycle of the vibration) but at the third peak (that is, after two cycles of the vibration), 1 cycle of the force vibration becomes void, so that a longer vibration time is required for removing residual stress.

The precussion treatment of the present invention includes generally one treatment wherein a work is subject to free vibration in a vertical plane, and the other, in a horizontal plane. A work is restrained by means of resiliency of rubber, spring or other members and gravity in the former treatment, and by means of resiliency of rubber, spring or other members in the latter. And in a cycle of vibration of the vibrator the work is released from the vibrator, then being subject to free vibration and further, coming to contact again with the vibrator, whereby the forced vibration of the vibrator is made the most of. As apparent from the preceding description, the resilient members are adapted to movably support a work with strength of such a degree as affording the work to be reliesed from the vibrator, subject to free vibration and then come to contact again with the vibrator in a cycle of vibration thereof.

That is, if the product is fixed with too strong resiliency of the resilient members, the product cannot be released from the vibrator, thus this treatment becomes the same with the conventional forced vibration method. However, in such a case, as the frequency of the vibrator not always accords with natural frequency of the work, residual stress thereof is hardly removed.

On the contrary, if the resiliency of the resilient member is too small, the work released from the vibrator by the vibration thereof is moved far away from the vibrator, so that a series of motions of release, free vibration and contact with the vibrator is performed not in a cycle but in several cycles of vibration of the vibrator and therefore necessary vibration time becomes longer.

According to the present invention, the frequency of the vibrator may be of any cycles as abovementioned, so that any means, for example, mechanical, electric, electromagnetic one or the like is applicable as a vibration source.

In addition, the amplitude and the exciting force of the vibrator is basically unlimited. However, the exciting force, the amplitude and the frequency relate to one another as follows.

$$G = C \cdot \mathrm{Hz}^2 \cdot A \qquad (1)$$

(where:
$G$ = exciting force
$C$ = constant
Hz = frequency
$A$ = amplitude)

Therefor, if the frequency is constant, G becomes large as A becomes large. But the amplitude and the exciting force may take any value within the range satisfying the abovementioned relation. This limitation is 1/Hz, that is, time required for a cycle or a period.

In the percussion treatment of the present invention in which a work is vibrated in a vertical plane, the work is subject to free vibration as follows. Firstly, a work is forced to vibrate by a vibrator, and is released from the vibrator at the loop or the peak of a vibration cycle, and then drops by gravity. After said release, the work is subject to free vibration, and that naturally at the natural frequency of the work. This free vibration is damped by the resistance of the air and damping factors of the work, so that the work does not always vibrate at the natural frequency thereof through the time of dropping by gravity. However, at a certain point in dropping time, it may be considered to vibrate at its natural frequency. By said vibration at the natural frequency, residual stress of the work is removed. If L is the length of drop by gravity and $t$ is time required for said dropping, the relation of the two is as follows.

$$L = 1/2gt^2 \qquad (2)$$

(where, $g$ = acceleration of gravity)

$L$ is within such a range as $0 < L \leqq 2A$. Consequently, suppose $$L = KA \qquad (3),$$

$K$ takes such a value as $0 < K \leqq 2$, whereby the ratio of the length $L$ of drop by gravity to the amplitude $A$ is shown. As the number of cycles of vibration of a work with the natural frequency $f$ without damping for said dropping time $t$ is $f \cdot t$, the whole number of cycles of the vibration of the work per 1 second is $\mathrm{Hz} \cdot f \cdot t$. If this is shown with a formula $$n = \eta \cdot \mathrm{Hz} \cdot f \cdot t \qquad (4)$$

$n$ in said formula indicates the number of cycles serving for removing the residual stress, in other word, the cycles of vibration of the work at the natural frequency $f$, while $\eta$ indicates, what is called, the efficiency.

If $T$ is time required for removing the residual stress of the work, and $N$ is the number of the effective cycles, then, from the abovementioned formulas (1) – (4), the formula $$N = \eta \cdot \mathrm{Hz} \cdot f \cdot t \cdot T$$
$$= \eta \cdot f \cdot T \cdot \sqrt{K} \cdot \sqrt{G} \cdot \sqrt{\frac{2}{g \cdot c}} \qquad (5)$$

is obtained. In the formula (5), $g = 9.8\ m^2/\mathrm{sec}$, $C = 3.96$ (in case of electric type) are substituted, $$N = 0.23\eta \cdot \sqrt{K} \cdot f \cdot \sqrt{G} \cdot T \qquad (6)$$

From the formula (6), it appears that the larger are natural frequency $f$ and exciting force $G$, the smaller becomes the time $T$ required for removing residual stress. In the formula (6), the values of $\eta$ and $K$ are below 1.0 and 2.0 respectively. Thereafter suppose $\eta = 1.0$, $K = 2.0$ are substituted in the formula (6), another formula $$N \leqq 0.33 f \cdot \sqrt{G} \cdot T \qquad (7)$$

is obtained.

The inventor has confirmed that the degree of the removal of residual stress according to the conventional resonance method is that, the vibration of substantially $3 \times 10^4$ cycles can make the value of residual stress zero or small enough to have substantially no effect.

Therefore, from the formula (7) and the abovementioned matters, the formula $$T \quad \frac{N}{0.33 f \sqrt{G}} \approx \frac{10^5}{f \sqrt{G}} \qquad (8)$$

is obtained. Here, for example, if the natural frequency of a work is 2,000Hz, and $G = 10$, from the formula (8), $$T \geqq 15.$$

That is, vibration time needs to be at least 15 seconds. It is natural that the practical $T$ changes with the values of $\eta$ and $K$, and takes the value above said minimum. The values of $\eta$ and $K$, especially $K$, are presumed to change with $\tau = 1/\mathrm{Hz}$, or the period. And if the work does not perform the release from the vibrator, free vibration and contacting with the latter in a cycle of the vibrator, $\eta$ takes an extremely undesirable value.

The abovementioned description is as to the case in which work is vibrated in a vertical plane, but similar is the case of the vibration in a horizontal plane. In the latter case, the acceleration of gravity $g$ is substituted by horizontal acceleration $\alpha$, and suitable value of $\alpha$ is obtained by making use of resiliency of the abovementioned resilient member.

In applying exciting force on a work, force transmitted to the work is not consistent, but applied in a form of vibrating waves based on the excited point. Therefore, in the conventional resonance method, a product is vibrated by a vibrator in the state of being completely fixed to the vibrator, so that residual stress in the portions of the work corresponding to the nodes of the vibration are left unremoved. In order to eliminate this disadvantage, the fixed position of the work must be changed with relation to the vibrator and then vibration must be repeated again. In the percussion treatment of the present invention, said disadvantage is also present, but a work is loosely fixed to a vibrator and so the contact portion possibly changes when the work is released from vibrator and comes into contact with the latter again. Therefore, portions of the work corresponding to the node of vibration changes, thus residual stress being apt to be made even. This is especially remarkable when a work is a ring. That is, in the percussion treatment of the present invention, unlike in the conventional resonance method, residual stress can be made even. However, in the percussion treatment of the present invention, especially in case of a flat work residual stress can be more surely made even by repeating vibration with the fixed portions changed.

In the heating treatment of the present invention, residual stress can be removed or at least made even by annealing at low temperature in the range of 200° – 600° C. It has been confirmed that especially in case of a work of ring-shape, the work annealed at about 200° – 300° C is applicable without any problems. It is known that, for example, seal rings (movable and fixed rings) for mechanical seal is produced of sintered alloy of cemented carbide including cobalt stress is left in the rings by machining the sealing surface thereof, and said residual stress causes seizure when the seal is in operation such as in lost motion. However, it was confirmed that if these machined rings are annealed at low temperatures about 200° – 300° C, seizure is not caused. Annealing at such a low range of temperature can be sufficiently performed in the air and a specific atmosphere is not necessary.

Works, the residual stress of which is removed or made even according to the abovementioned percussion treatment or heating treatment, may serve as excellent mechanical parts, members for construction works and the like, and if they are applied, for example, to mechanical seals for an underwater pump, seizure of the seal rings are completely prevented. Driven rings and seat rings are used as said sealing rings, and these rings are formed of cemented carbide. When sintered works are subjected to machining ring shaped works tend to become oval instead of round immediately upon sintering. Further, the machining is performed so that a sliding surface and a fitting face of the sintered works to be used as the mechanical seals should be maintained with a high accuracy. However, it is known that when such sintered works are subjected to the machining such as grinding or lapping, the surface thereof show a strong residual stress or strain. For example, a piece of cobalt based alloy (12.7 × 12.7 × 9.3mm) containing 10% by weight of cemented carbide was abraded in a single direction with a diamond paste of 6$\mu$ and the residual stress was measured with an X-ray diffraction meter. As the result thereof, a residual stress of $-204$ Kg/mm$^2$ was observed. This value of the residual stress equals to the sum of the inherent thermal stress of $-32$ Kg/mm$^2$ and mechanical stress of $-172$ kg/mm$^2$ which was caused by the abrasion. Said thermal stress is caused by the difference of thermal elasticity between the cemented carbide and the cobalt. Thus, it is apparent that the residual stress caused by grinding and lapping is exerted on the sealing face and on the cylindrical end face in case of seal rings for mechanical seals, and the residual stress is increased considerably at an outer peripheral portion of the sealing face due to the incorporation of the residual stresses both of the sealing face and the cylindrical end face.

As mentioned above, however, the shape of seal rings immediately upon sintering is not round but oval, and when the grinding process is applied therefor, a considerable portional difference is seen in the strength of residual stress exerted at the cylindrical end face due to the diference in machining thickness. The peripheral portion of the sealing face, therefore, possesses locally considerably strong and uneven residual internal stress. It can be understood that, in the seal rings comprising a pair of a seat ring and a driven ring both of which having the residual stress as just mentioned and the same sized bore, a number of fine creeping parts are formed mainly at the outer peripheral portion of the sealing face on account of the friction heat generated by rotation. Said fine creeping parts tend to be overheated due to the formation of said fine creeping parts in addition to the pressure upon the contacting surfaces between the seat ring and the driven ring, thereby causing rupture of the oil film and, consequently, seizure at the outer peripheral portion of the sealing face.

In an underwater pump particularly of the type used in construction work where water including earth and sand is pumped, a sealing apparatus for such underwater pump comprises, for example, seal rings made of hard carbide alloys the main component of which is cemented carbide. When such underwater pump is desirable to be made portable by reducing the size and weight thereof, such reduction in the size and weight can be attained by a high speed rotation of the pump to increase the pumping-up volume of water. In this connecting, the oil film rupture readily occurs at the sliding surface of the seal rings of the sealing apparatus owing to the increase of r.p.m. The oil film rupture readily occurs at the sliding surface of the seal rings also because of the fact that the underwater pump for the construction work is often dry run, that is, run nearly with no load at the construction site. Further, the possibility of seizure of the sliding surface of the seal rings is great when the underwater pump is run on trial. In all cases of the seizure the fine creeping parts are susceptible to seizure as described above, and it is obvious that such local fine seizure causes the overall seizure.

Under the circumstances, I have attempted to use seal rings made of cemented carbide having uniform residual internal stress. These seal rings were shaped and machined to obtain a smooth surface and were made free from the residual stress other than the inherent thermal stress resulting from the difference of thermal elasticity between the components of the alloy. It was then observed that the abovementioned forms of seizure may be avoided. My success in avoiding the occurences of seizure is attributed mainly to the fact that I have succeeded in avoiding the occurrence of the seizure that would be usually caused due to the uneven creeping formed at the outer peripheral portion of the sealing face.

The other features and advantages of the present invention will become apparent from the following description of embodiments with reference to the accompanying drawings.

Figure 1:
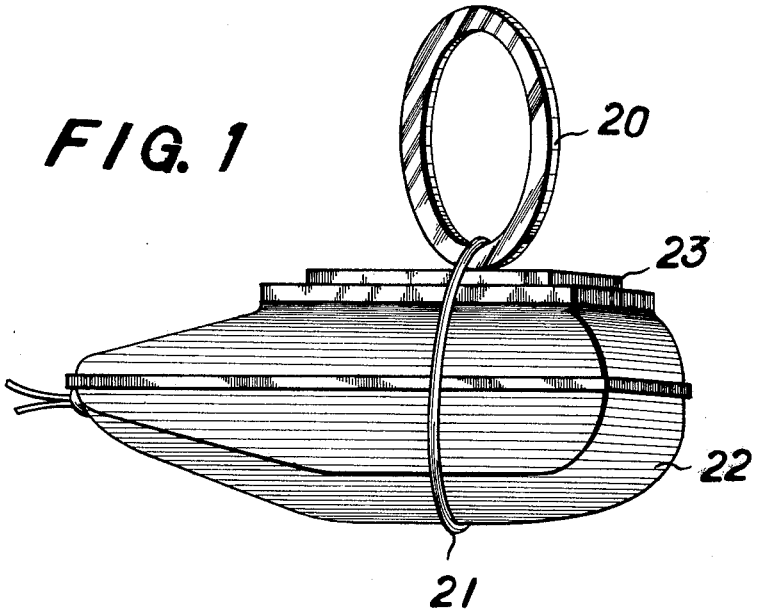
FIGS. 1–7 are explanatory views of a vibrator and a work fixed thereto by means of resilient members, which are used for performing the percussion treatment of the present invention.

Referring to FIG. 1, an elastic string 21 is used as a resilient member for fixing a work 20. Such a resilient member is suitable for a small size of a work 20. As a vibrator 22, an electric magnetic one (output 14VA, exciting force about 3G) is adopted. The work 20 is mounted on a vibrating plate of the vibrator 22, and, as shown in the drawing, fixed thereon by means of a plastic code of a diameter 1.5mm with such a tention as prevents the work from falling down during the vibration, and then vibrated at the commercial frequency.

Figure 2:
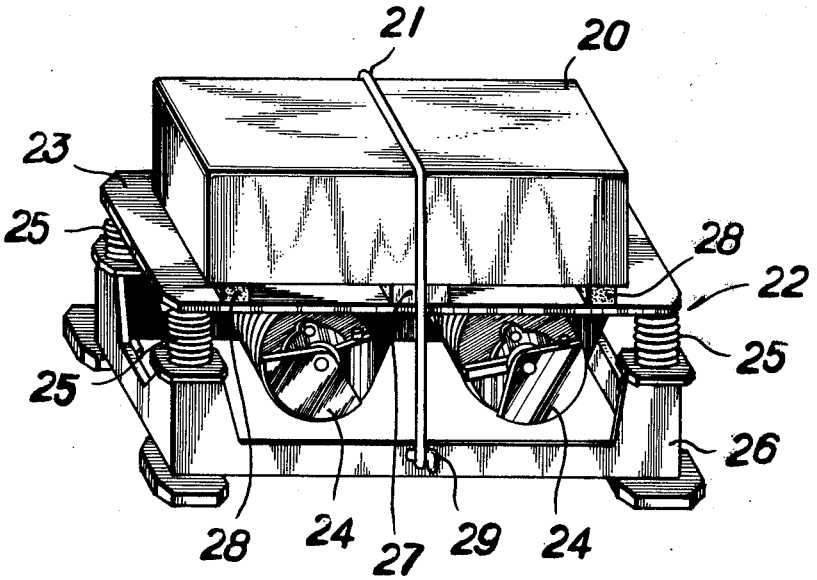

Referring FIG. 2, similarly to FIG. 1, an elastic string 21 is used for fixing a work 20, but this device is suitable for a work of a rather large size. The work 20 is hollow or box-shaped (that is, having U-shaped section). Two shaking motors 24 are fitted to the lower surface of the vibrating plate 23, which is mounted on a base 26 by means of springs 25, 25 . . . , whereby a vibrator 22 is formed. In the center of the upper surface of the vibrating plate 23 provided is a plate-shaped extended portion 27, which is adapted to serve as a vibrating source for the work 20. Sponge plates 28 are provided between the work 20 and the vibrating plate 23 so as to prevent the work 20 from inclining or contacting with the vibrating plate 23. The elastic string 21 of a diameter about 2–3mm is used for restraining and fixing the work 20 by using a hook 27 fitted to the base 26.

Figure 3:
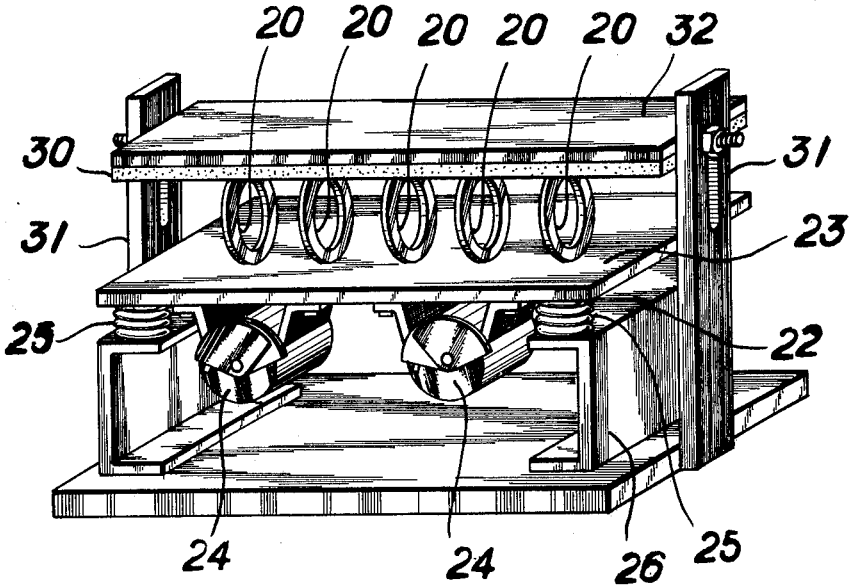

Referring FIG. 3, foamy elastic material plate, for example, urethan foam plate 30 is used as a resilient member. Such device is suitable for a work 20 of a small size. Similarly to the vibrator of FIG. 2, two shaking motors 24 are fixed to the lower surface of the vibrating plate 23, which is mounted on the base 26 by means of springs 25, 25 . . . , whereby a vibrator 22 is formed. However, in the vibrator of FIG. 3, on the base 26 mounted are frames 31, 31, on which said urethan foam plate 30 is mounted by means of a lateral frame 32. Works 20, 20 . . . are arranged and loosely fixed between the urethan foam plate 30 and the vibrating plate 23. The thickness of the urethan foam plate is, for example, about 30mm.

Figure 4:
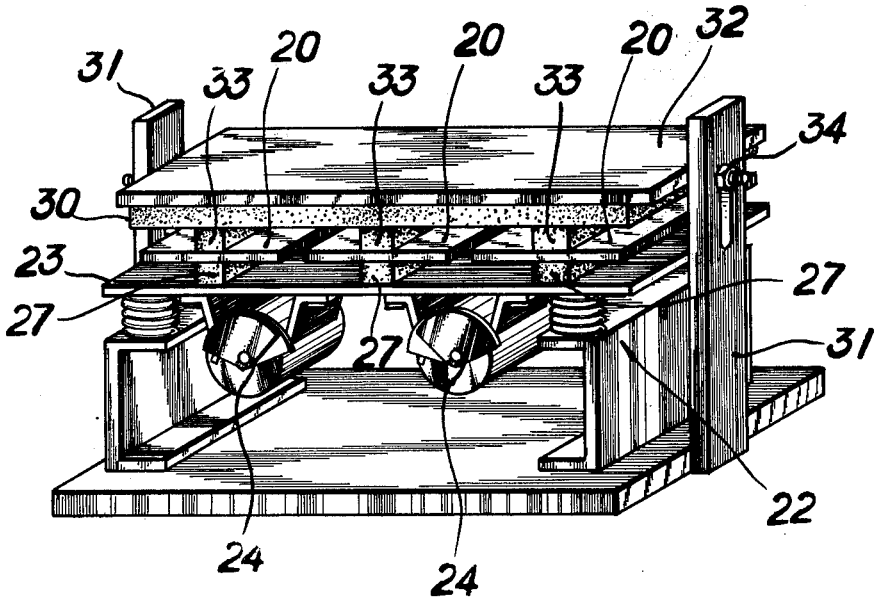

Referring to FIG. 4, similarly to the vibrator of FIG. 3, a foamy elastic material plate 30 is used as a resilient member. This device is suitable for a work 20 of a rather large size. A vibrator 22 is constructed similarly to that of FIG. 3. On the vibrating plate 23 provided are a required number of plate-shaped extended portions 27, 27 . . . , which are adapted to serve as vibrating sources for the works 20, 20 . . . . The resilient member 30 has extended portions 33, 33 . . . which are of the same shape with extended portions 27, 27 . . . provided on the vibrating plate 23, and formed of urethan foam of 60mm thickness. Fixing members 34 are adjusted so as to loosely restrain and fix the works 20, 20 . . . arranged between both of the extended portions 27, 33. The upper surface of the extended portion 27 may be flat as shown in the drawing or spherical.

In the embodiments shown in FIGS. 1–4, metal herical, spiral or leaf springs or the like may be used as resilient members in place of said elastic string or urethan foam plate.

Figure 5:
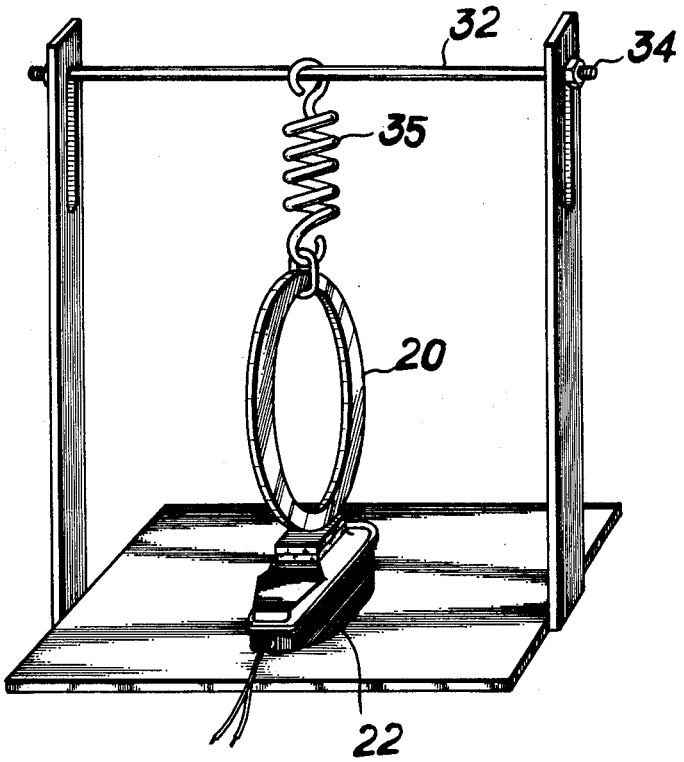

A vibrator shown in FIG. 5 is applicable to a work 22 which is rather heavy in comparison with the capacity of the vibrator 22. In this example, the capacity of the electromagnetic vibrator 22 is 14VA output and about 3G of exciting force, while the work 20 is a ceramic ring of 139mm outer diameter, 99mm inner diameter and 20mm thickness, and of 540g weight. The work 20 is mounted on the lower end of a helical spring 35 suspended from a lateral frame 32, and a fixing member 34 is so adjusted that the work 20 is in contact with the vibrating surface of the vibrator 22 in the state that the helical spring 35 is extended by the weight of the work 20 and balanced therewith.

Figure 6:
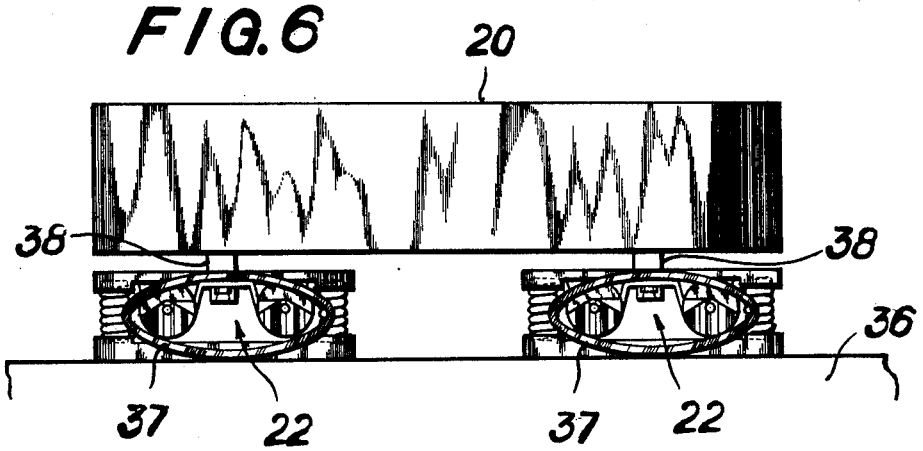

A vibrator 22 shown in FIG. 6 is applicable to an extremely heavy work 20. For example, this vibrator is applied when the work 20 is as heavy as weighed by tons and the capacity of the vibrator 22 is rather small. The work 20 is positioned on members 38, 38 mounted on two leaf springs 37, 37 arranged on a base 36. The lower sides of the members 38, 38 are put in contact with the vibrating surface of the vibrators 22, 22 in such a state that the leaf spring is bent by the weight of the work 20 and balanced therewith.

Figure 7:
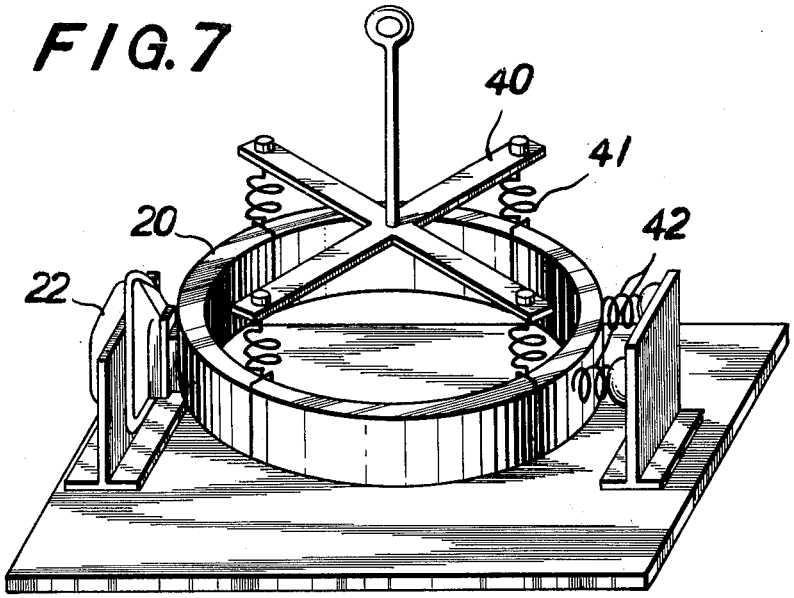

A vibrator 22 shown in FIG. 7 is adapted to vibrate a work 20 in the horizontal direction. A work 20 is suspended by means of helical springs 41, 41 . . . , and vibrated in the horizontal direction by a vibrator 22, and pushed back toward the vibrator 22 by means of springs 42, 42. The springs 41, 42 may be substituted by other elastic members such as rubber or sponge members.

As apparently shown in the abovementioned embodiments, in embodying the present invention, it is important that a work is movably supported by means of a resilient member, and forcedly vibrated by a vibrator, then the work being subject to free vibration in the state of being apart from the vibrator. And then it is necessary that the works comes to contact with the vibrating surface of the vibrator again by the resiliency of said resilient member or said resiliency and weight of the work.

Figure 8:
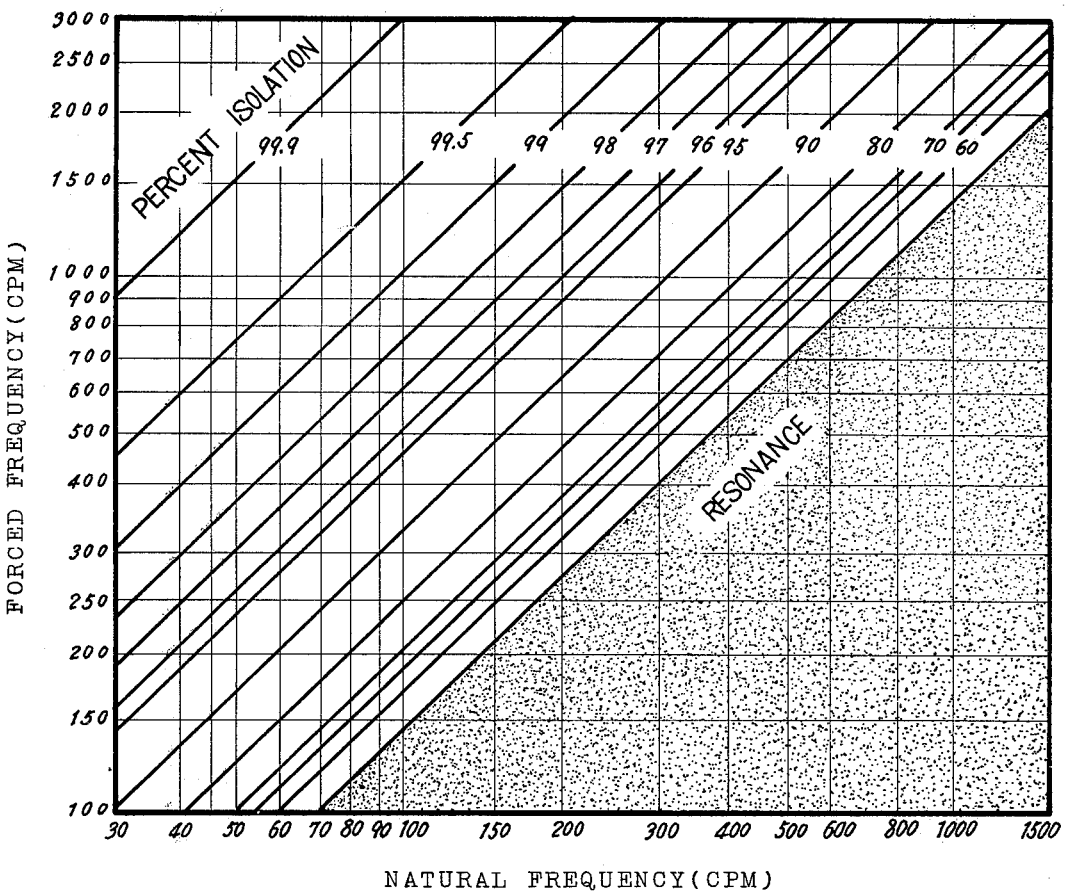
FIG. 8 is a vibration isolation chart showing the relation between the natural frequency and the forced frequency of a work.

FIG. 8 is a chart cited from a book on vibraton. As apparent from the chart, there is an interrelation between natural frequency of a work and forced vibration frequency of a vibrator, and the point at which said two frequencies coincide with each other is so-called resonance point, which is made much of in the conventional method. When frequency of a vibrator is larger than natural frequency of a work, so-called isolation occurs. Therefore in the method of the present invention frequency of a vibrator must not be larger than natural frequency of a work.

Figure 9:
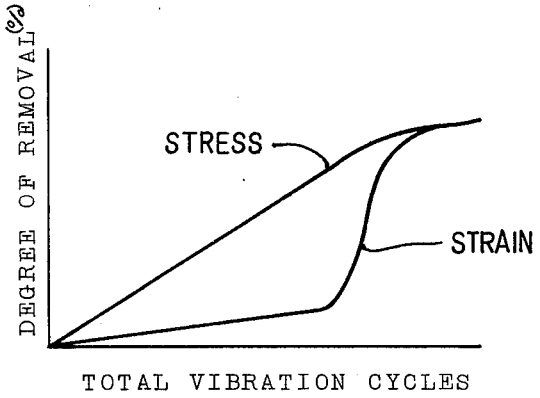
FIG. 9 is a chart showing the extent of removal of stress and distortion with relation to the whole number of excitations applied.

FIG. 9 is a chart showing in the conventional method how the degree of removal of stress and strain in a work is influenced by the whole cycles of vibration applied on the work. It is apparent from the chart that the larger is the whole cycles of vibration applied, the larger is the releaf rate (removed stress/residual stress present before removal), but that when the whole cycles of vibration applied reaches the order of $10^5$, the relief rate hardly changes. Therefore, $10^5$ times at most of vibration is satisfactory for removing residual stress and strain and practically $10^4$ times of vibration may be satisfactory. Howver, as shown in the chart, for removing strain, at the vibration about $10^4$ times the relief rate is small, and $10^5$ or more times of vibration is necessary. The gradients of stress and strain and different from each other, the reason of which is not known.

Figure 10:
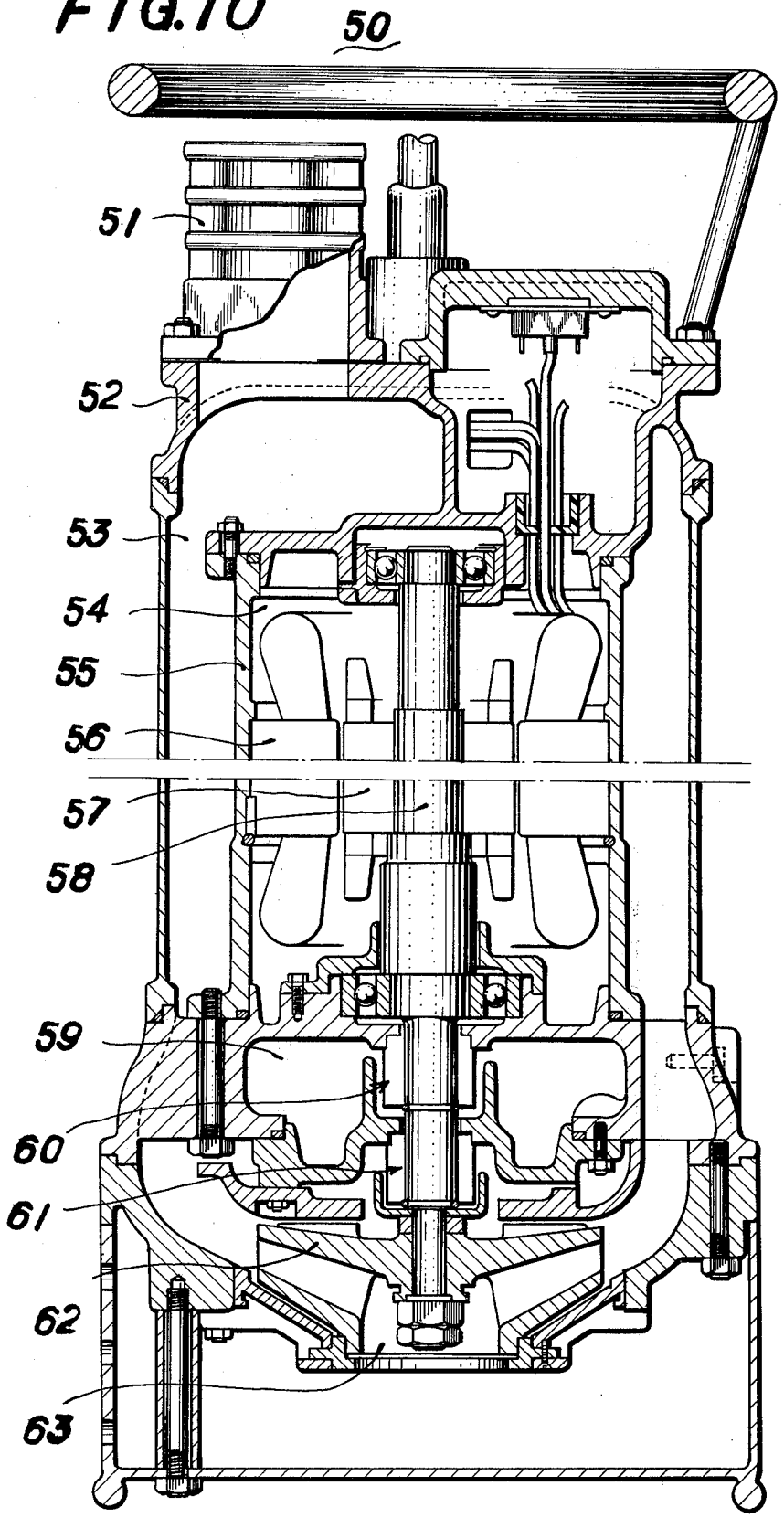
FIG. 10 is a longitudinal sectional view of an underwater pump provided with seal rings for mechanical seal, the residual stress of which is removed or made uniform according to the method of the present invention.

In FIG. 10 shown is an underwater pump 50. The pump 50 has a casing 52 constructed by combining several parts. Above said casing is an outlet pipe 51 and at the lower end of the casing inlet port 63 opens. Inside the casing 55 a motor is fitted by means of a motor casing 55, the construction of which is well-known. A water passage 53 is formed between the motor casing 55 and the casing 52. The motor casing 55 has at the lower end thereof sealing means 60, 61, which are mentioned below in detail, thereby being completely separate and independent from the water passage 53, and being airtight. Inside the motor casing 55 rotatably mounted is an axis 58 having a required number of rotors 57, 57 . . . , and further provided are stater 56, 56 . . . outside the rotors 57 . . . and inside the motor casing, whereby a motor portion of the pump is formed.

At the ower end of the axis 58 fitted is a impeller 61 by means of sealing means 60, 61. The impeller 62 is positioned at said inlet port 63, from which water is sucked in.

Figure 11:
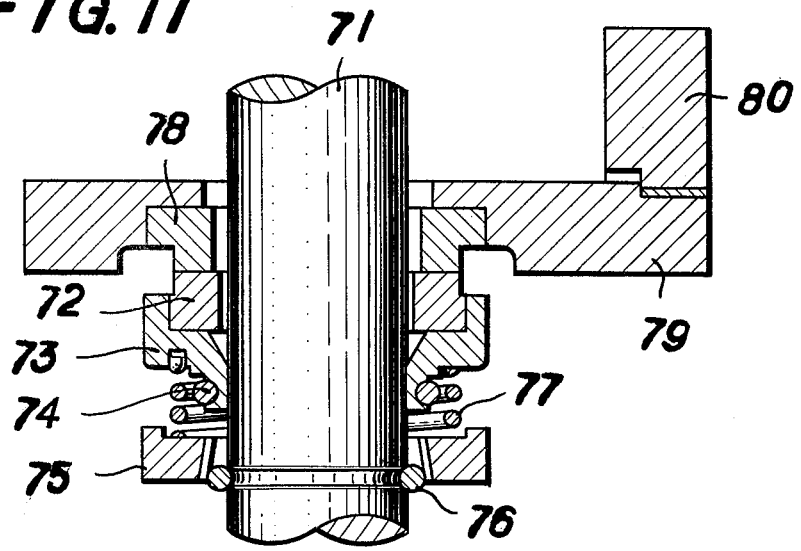
FIGS. 11–13 are sectional views of the mechanical seals, each of which is fitted to a shaft in a different manner respectively.
Figure 12:
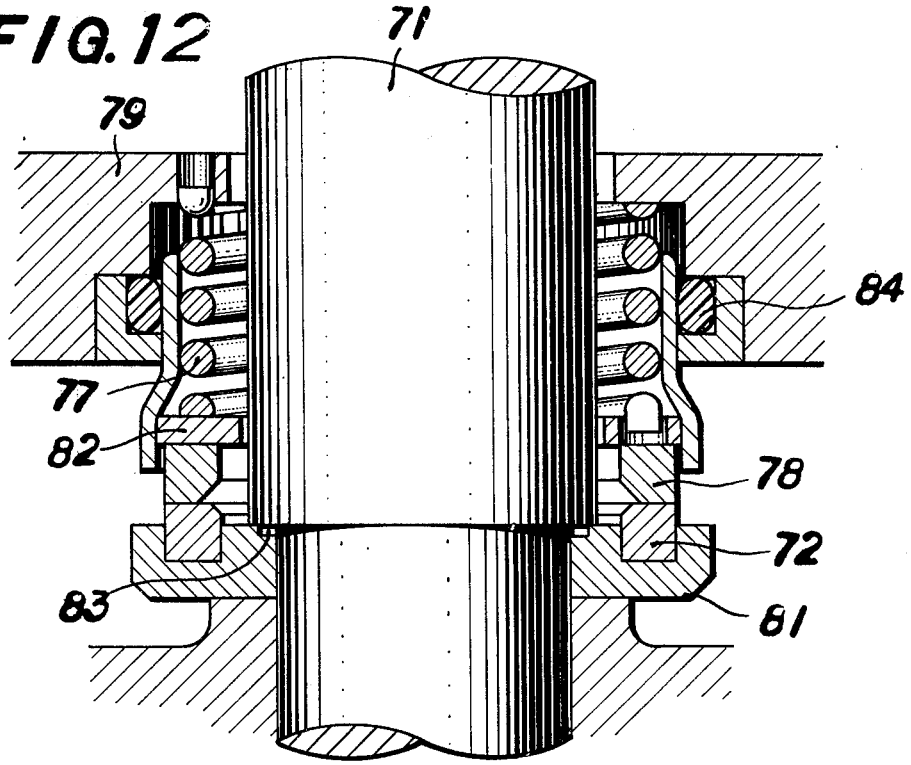
Figure 13:
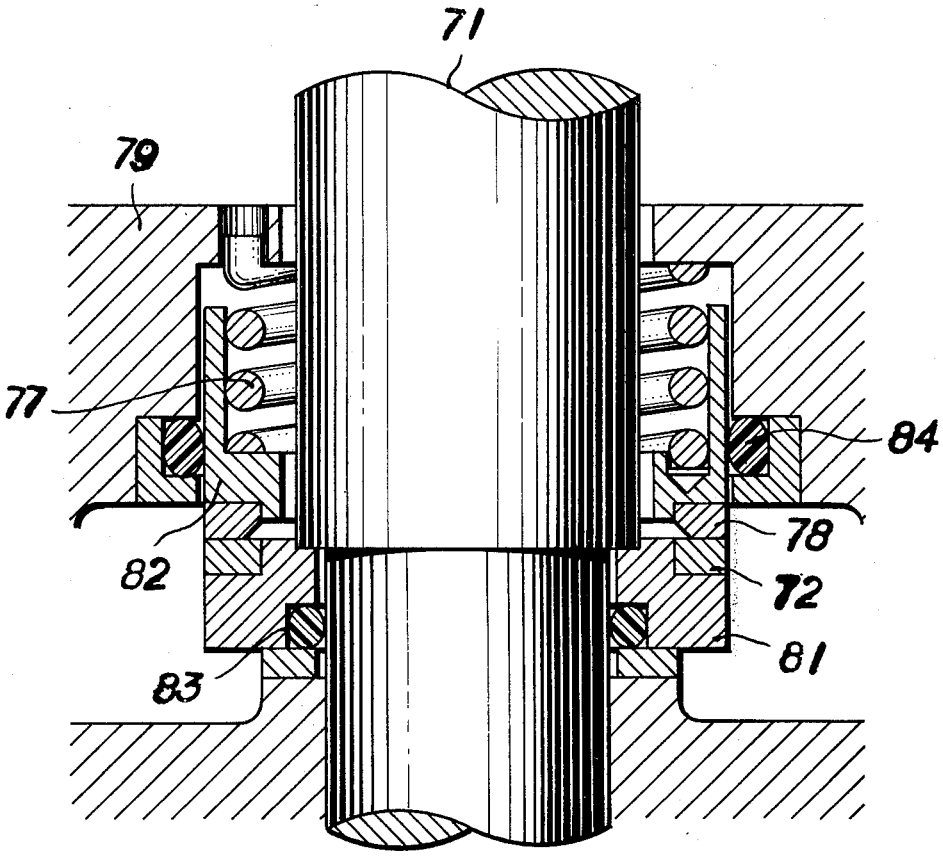

Said sealing means 60, 61 are mechanical seals mentioned below. Residual stress of sealing rings used in said mechanical seals is removed or made uniform by the method of the present invention, thereby preventing seizure and affording a long time operation. The numeral 59 indicates an oil chamber. In FIGS. 11–13 shown are examples of sealing means, which are applicable to any construction adapted to use mechanical seals in any field where sealing is required, of course, including abovementioned underwater pumps. In the drawing the numeral 71 indicates an axis which corresponds to the axis 58 in said underwater pump 50. On said axis 71 fitted is a cemented carbide driven ring 72. The driven ring 72 is held by a seal retainer 73 and is mounted thereon removably. The seal retainer 73 is pressed from a peripheral edge thereof towards the shaft 71 by a retainer spring 74. Numeral 75 is a stop ring which not only holds a compression spring 77 but acts upon the driven ring 72 to press it against a seat ring 78 by means of the compression spring 77. The compression spring 77 is interposed between the stop ring 75 and the seal retainer 73, and provides the driven ring 72 with a suitable repelling power. The seat ring 78 is fixed to a housing 79 and is situated opposite to said driven ring 72. The seat ring 78 is made of the hard carbide alloy same as the driven ring 72. Numerals 80 represent a casing, 81 a housing for the driven ring, 82 a washer, and 83 and 84 O-rings.

EXAMPLE 1

A ring of 30mm outer diameter, 20mm inner diameter and 5mm thickness formed of cemented carbide was subject to percussion treatment of the present invention under the condition of normal temperature, 3G exciting force and 75Hz frequency of the vibrator. The result was that $-45Kg/mm^2$ residual stress measured before the vibration was reduced to $-30Kg/mm^2$ thereafter. Said residual stress was measured at the outer peripheral surface.

EXAMPLE 2

A ring of the same material and form with those of the ring used in Example 1 was subject to the percussion treatment of the present invention under the condition of normal temperture, 3G exciting force and 30Hz frequency of the vibrator. The result was that $-50Kg/mm^2$ residual stress measured before the vibration was reduced to $-32Kg/mm^2$ thereafter.

EXAMPLE 3

A ring of 39mm outer diameter, 31mm inner diameter and 8mm thickness formed of carbon steel was subject to the percussion treatment of the present invention under the condition of normal temperature, 3G exciting force and 75Hz frequency of the vibrator. The result is that $+68Kg/mm^2$ residual stress measured before the vibration was reduced to $+17Kg/mm^2$ thereafter. Said residual stress was measured in the diametrical direction of the sealing surface.

EXAMPLE 4

A sheet of 53mm length, 16mm width and 2mm thickness formed of alimina-ceramic was subject to the percussion treatment of the present invention under the condition of normal temperature, 3G exciting force and 30Hz frequency of the vibrator. The result was that $+7.5Kg/mm^2$ residual stress measured before the vibration was reduced to $-1.0Kg/mm^2$ thereafter. Said residual stress was mesured on the plane surface of said 16mm × 53mm area.

EXAMPLE 5

A ring of 139mm outer dimeter, 99mm inner diameter and 20mm thickness formed of alumina ceramic was subject to the percussion treament of the present invention under the condition of normal temperature, 3G exciting force and 75Hz frequency of the vibrator. The result was that $+53Kg/mm^2$ residual stress measured before the vibration was reduced to $+26Kg/mm^2$ thereafter. Said residual stress was measured at the outer peripheral surface.

In each of the abovementioned examples, the vibrating time was about 30 minutes. The vibrating time possibly may be shortened.

EXAMPLE 6

A ring of 50mm outer diameter 30mm inner diameter and 9mm thickness formed of alumina-ceramic was subject to the percussion treatment of the present invention under the condition of normal temperature, 10G exciting force, 30Hz frequency of the vibrator and 20 minutes vibrating time. The result was that $+85Kg/mm^2$ residual stress measured before the vibration was reduced to $+26Kg/mm^2$ thereafter, and similarly $+68Kg/mm^2$ before the vibration to $+23Kg/mm^2$ thereafter. Said residual stress was measured in the circumferential direction.

EXAMPLE 7

A plate of 100 mm length, 30mm width and 3mm thickness formed of tungsten-carbide was subject to the percussion treatment of the present invention for 40 minutes under the condition of normal temperature, 3G exciting force and 30Hz frequency of the vibrator. The result was that +150Kg/mm² and 158Kg/mm² residual stresses measured before the vibration were reduced to −32Kg/mm² and −40Kg/mm² respectively. The former stress was measured in the lateral direction of the surface, and the latter in the lateral direction of the rear surface.

EXAMPLE 8

A ring formed of cemented carbide including 12% of cobalt was vibrated by 10G–11G exciting force for 20 minutes. The results were shown in the following table 1. Said residual stresses were measured at the outer peripheral surface.

Table 1

| sample No. | | 1 | 2 | 3 | 4 | 5 |
|---|---|---|---|---|---|---|
| (outer diameter-inner diameter) × thickness mm | | (35–23)×5 | (35–23)×5 | (27–17)×3 | (27–17)×3 | (40–31)×3 |
| frequency of the vibrator Hz | | 4300 | 4300 | 30 | 30 | 30 |
| residual stress Kg/mm² | before Test | −45 | −75 | −30 | −45 | −45 |
| | after Test | −30 | −30 | −30 | −30 | −23 |

EXAMPLE 9

A ring of 44mm outer diameter, 31mm inner diameter and 7mm thickness formed of alumina ceramic was subject to percussion treatment of the present invention for 20 minutes with 11G exciting force and at 4350Hz frequency of the vibrator. The result was that +85Kg/mm² and 68Kg/mm² residual stresses measured before the vibration were reduced to +26Kg/mm² and 21Kg/mm² respectively thereafter. Said residual stresses were measured at the outer peripheral surface.

Residual stress was measured as abovementioned, and the following is the examples of measuring strain.

Figure 14:
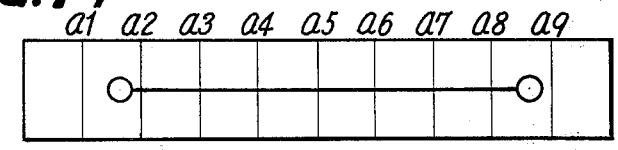
FIGS. 14–16 are explanatory views of specimens for distortion test.
Figure 15:
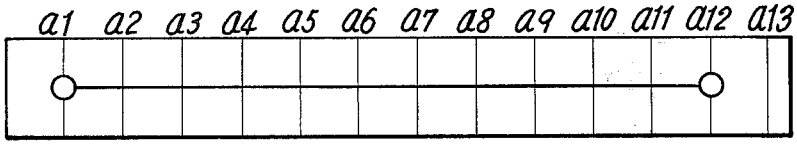
Figure 16:
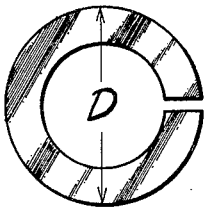

In the following examples, specimens were formed as shown in FIGS. 14–16 and the strain thereof was measured. For making plate-shaped specimens, a specimen of 100mm width made first, and then divided into two specimens of 50mm width. This is because the direction of residual stress varies with the direction of rolling of a steel plate and such difference should not have influence on the results of the test. Said specimen plates thus divided were each worked as shown in FIGS. 14 or 15. That is, in each plate bored were two holes of 13.8mm diameter respectively, between which the plate were severed with a saw to form a slit of about 0.5mm width, and then the slit portion was welded. One of said two divided specimens was subject to the percussion treatment of the present invention, while the other was not subject thereto, then two specimens being severed at the welded portion. Strain before and after vibration was measured by measuring with a calipers having a vernier the width of the plate at the marked positions spaced by 30mm width from each other. In case of ring-shaped specimens, one of the two induction hardened rings was subject to the percussion treatment, while the other was not subject thereto. In both of the rings formed is a slit in the radial direction, and strain was measured before and after the vibration treatment.

EXAMPLE 10

A sheet of 300mm length, 50mm width and 1.6mm thickness formed of steel including 0.067% of carbon was subject to welding with a 2mmϕ welding rod at 45 ampere, at the welding rate of 260mm/2 minutes and in 264mm welding line. And then it was subject to the percussion treatment for 1 hour with 6G exciting force and at 30Hz frequency of the vibrator. The results shown in table 2.

Table 2

| measured position | | $a_1$ | $a_2$ | $a_3$ | $a_4$ | $a_5$ | $a_6$ | $a_7$ | $a_8$ | $a_9$ |
|---|---|---|---|---|---|---|---|---|---|---|
| strain mm | Unvibrated specimen | 0.1 | 0.27 | 0.37 | 0.47 | 0.48 | 0.45 | 0.35 | 0.21 | 0.09 |
| | vibrated specimen | 0.06 | 0.25 | 0.35 | 0.42 | 0.41 | 0.35 | 0.26 | 0.15 | 0.04 |
| | removed strain | 0.04 | 0.02 | 0.02 | 0.05 | 0.07 | 0.10 | 0.09 | 0.06 | 0.05 |

EXAMPLE 11

A plate of 400mm length, 50mm width and 2.3mm thickness was welded with a 2.6mmϕ welding rod in 270mm welding line, at 45 ampere of electric current, at the welding rate of 330mm/3 minutes, and then subject to the percussion treatment for 1 hour with 6G exciting force and at 30Hz frequency of the vibrator. The result is shown in table 3.

Table 3

| measured position | | $b_1$ | $b_2$ | $b_3$ | $b_4$ | $b_5$ | $b_6$ | $b_7$ | $b_8$ | $b_9$ | $b_{10}$ | $b_{11}$ | $b_{12}$ | $b_{13}$ |
|---|---|---|---|---|---|---|---|---|---|---|---|---|---|---|
| strain mm | unvibrated specimen | 0.02 | 0.13 | 0.56 | 0.82 | 0.99 | 1.04 | 1.10 | 1.12 | 1.02 | 0.84 | 0.55 | 0.18 | 0.00 |
| | vibrated specimen | 0.01 | 0.11 | 0.37 | 0.62 | 0.71 | 0.68 | 0.57 | 0.63 | 0.60 | 0.60 | 0.50 | 0.11 | 0.00 |
| | removed | 0.01 | 0.02 | 0.19 | 0.20 | 0.28 | 0.36 | 0.53 | 0.49 | 0.42 | 0.24 | 0.05 | 0.07 | 0.00 |

Table 3-continued

| measured position | $b_1$ | $b_2$ | $b_3$ | $b_4$ | $b_5$ | $b_6$ | $b_7$ | $b_8$ | $b_9$ | $b_{10}$ | $b_{11}$ | $b_{12}$ | $b_{13}$ |
|---|---|---|---|---|---|---|---|---|---|---|---|---|---|
| strain | | | | | | | | | | | | | |

EXAMPLE 12

A plate of 400mm length, 50mm width and 2.0mm thickness formed of stainless steel was welded with a 2.0mmϕ welding rod in 250mm welding line at 40 ampere, of electric current, at the rate of 250mm/2 minutes, and was subject to the percussion treatment for 1 hour with 6G exciting force and at 30Hz frequency of the vibrator. The result is shown in table 4.

Table 4

| measured position | | $b_1$ | $b_2$ | $b_3$ | $b_4$ | $b_5$ | $b_6$ | $b_7$ | $b_8$ | $b_9$ | $b_{10}$ | $b_{11}$ | $b_{12}$ | $b_{13}$ |
|---|---|---|---|---|---|---|---|---|---|---|---|---|---|---|
| strain mm | unvibrated specimen | 0.01 | 0.08 | 0.24 | 0.39 | 0.46 | 0.47 | 0.46 | 0.47 | 0.45 | 0.40 | 0.25 | 0.05 | 0.00 |
| | vibrated specimen | 0.00 | 0.02 | 0.21 | 0.36 | 0.35 | 0.31 | 0.30 | 0.31 | 0.31 | 0.26 | 0.21 | 0.03 | 0.00 |
| | removed strain | 0.01 | 0.06 | 0.03 | 0.03 | 0.11 | 0.16 | 0.16 | 0.16 | 0.14 | 0.14 | 0.04 | 0.02 | 0.00 |

EXAMPLE 13

A ring of 39mm outer diameter, 31mm inner diameter and 8mm thickness formed of stainless steel was induction-hardened, and then subject to the percussion treatment for 30 minutes with 9G exciting force and 30Hz frequency of the vibrator. The result was that −0.539mm strain before the vibration was reduced to −0.143mm thereafter, therefore the value of removed strain being 0.396mm.

EXAMPLE 14

A ring of 39mm outer diameter, 31mm inner diameter and 8mm thickness formed of carbon steel including 0.45% of carbon was induction-hardened, and then subject to the percussion treatment for 30 minutes with 9G exciting force and 30Hz frequency of the vibrator. The result was that +0.040 strain measured before the vibration was reduced to −0.013mm thereafter, therefore the value of the removed strain being 0.053mm.

EXAMPLE 15

A ring of 35mm outer diameter, 23mm inner diameter and 5mm thickness formed of cemented carbide including 12% of cobalt was machined and then annealed at the temperature of 200° C for 1 hour. The result was that −30Kg/mm² residual stress measured before the annealing was reduced to −15Kg/mm² thereafter. Further, a ring of the same shape was annealed at the temperature of 300° for 1 hour. The result was that −75Kg/mm² residual stress was reduced to −30Kg/mm² thereafter.

EXAMPLE 16

After the seat rings 78 having a diameter of 40–30mm and the driven rings 72 having the same size of outer diameter both made of cemented carbide were machined, they were heated for one hour at a temperature of 200° C and then were cooled in air or water. Each of the seat rings 78 thus obtained were fixed to the housing 79 of underwater pumps (bipolar motors, 5PS and 10PS) for construction work, and both underwater pumps were run with no load for 70 minutes. During said running a thermoconstantan was provided in each of the underwater pumps between the seat ring 78 and the housing 79 to measure the rise of temperature of the seat rings 78.

Said no load running resulted in that, in both 5PS and 10PS underwater pumps, the sealing faces showed no seizure and remained extremely stable. The temperature rises indicated at end faces of the seat rings were 70° C and 75° C for the 5PS and 10PS underwater pumps respectively. Seat rings and driven rings of the same shapes as said seat rings 78 and driven rings 72 but which were not treated by heating as described above were also tested in the same way as just mentioned, and in both instances seizure ws observed after 5 to 10 minutes.

Internal stresses remaining at outer peripheries of the end faces of seat rings prior to the heat treatment were −45Kg/mm² to −75Kg/mm² which were reduced to −30Kg/mm² after said treatment, such internal stress being in the region of thermal stress of −32Kg/mm² resulting from the difference of thermal elasticity between constituents of the hard carbide alloys.

The foregoing no load running test was repeated with 5PS pump at various pressure applied to the sealing face using compression springs 77 with different compression forces.

The seizure of seal rings prior to the heat treatment took place at a pressure between 1.4 to 1.5Kg/cm², while the critical pressure for the seizure of the heat-treated seal rings was raised to 2.1 to 2.3Kg/cm² which is well higher than that of the conventional pump of this type which ws 1.8Kg/cm².

EXAMPLE 17

A seat ring and a driven ring made of a hard carbide alloy same as in example 16 were ground, and internal stresses remained at outer cylindrical peripheral surfaces of the seat ring and the driven ring were reduced by applying a heat treatment at 300° C resulting in thermal stress of the cemented carbide −30Kg/mm² to −25Kg/mm².

EXAMPLE 18

After the same seat rings and driven rings as in example 16 were machined, they were subjected to annealing for about one hour in an atmosphere of hydrogen at temperatures of 750° C to 850° C, and were fixed in 5PS and 10PS underwater pumps which were run with no load as in example 16. In this case the temperature rise measured at end faces of the seat rings was 69° C for the 5PS underwater pump and 73° C for the 10PS underwater pump.

Although the annealing in an atmosphere of hydrogen was employed in the present example, such treatment can be as well peformed in the general open air if the purpose of the treatment was to mainly reduce the residual stresses at inside and outside cylindrical surfaces. The annealing time may be from 5 minutes to 1 hour depending on the shape and size of the seat rings and the driven rings and on strength after annealing.

EXAMPLE 19

Seat rings 78 and driven rings 72 were each formed in a ring-shape by sintering of alumina ceramic having almina for its main component, then ground with a grinder, heated at the temperature of 300° C for 1 hour and were subject to shelf cooling and lapping of sliding surface. Said rings were fitted in a bipolar underwater pump of 5PS for construction work. And the pump was operated for 100 hours in water including about 10% of earth and sand. The result was that the sliding surface maintains the normal sealing effect. On the contrary, in the rings which had not been subject to abovementioned heat treatment, the sliding surface for sealing become rough to the touch, the inner peripheral edge ws injured and water leakage was observed in the oil chamber 59.

The residual stress in the sliding surface was +45 − +43Kg/mm² before the heating treatment, and it was reduced to +21Kg/mm² after said treatment. Said value is nearly equal to that of natural thermal stress of ceramic.

EXAMPLE 20

After the same seat rings and the driven rings as in Example 16 were machined, they were subjected to the percussion treatment by effecting vibration for about 10 minutes in the direction of end faces of the seat rings and the driven rings at natural frequencies thereof of 1,500Hz applying acceleration at a degree of about 10G. Said seat rings and driven rings were then fixed to the underwater pumps for construction work same as in example 16 and were run with no load same as in said example 16. The sealing faces showed no seizure and remained extremely stable in this case too, and the temperature rises measured were 69° C for the 5PS underwater pump and 73° C for the 10PS underwater pump.

The residual stresses which were present at the outer peripheries of the sealing faces of seat rings and driven rings prior to the vibratory stress relief treatment were −60Kg/mm² and −75Kg/mm² respectively. and they were both reduced to −30Kg/mm² after said treatment.

EXAMPLE 21

After the same seat rings and driven rings as in example 16 were machined, one side of each of these rings was fixed with an elastic material to a vibrating table. These rings were then subjected to the percussion treatment by effecting vibration to the vibrating table for about 20 minutes in the direction of end faces of the seat rings and the driven rings at frequencies of 30Hz applying acceleration at a degree of about 10G. After this, said seat rings and driven rings were fixed to the underwater pumps for construction work same as in example 16 and were run with no load same as in said example 16. The temperature rises measured at sealing faces of the seat rings and the driven rings were also 69° C for the 5PS underwater pump and 73° C for the 10PS underwater pump.

Further tests were carried out substituting the working frequencies of 100Hz, 60Hz and 10Hz for the abovementioned 30Hz, and the same results were obtained.

The residual stresses which were present at the outer peripheries of the sealing faces of seat rings and driven rings prior to the percussion treatment were −45Kg/mm² for both rings, and this figure was reduced to −23Kg/mm² after said treatment.

EXAMPLE 22

Seat rings and driven rings similar to those of Example 9 were subject to the percussion treatment for 20 minutes with 10G exciting force and at 30Hz frequency of the vibrator as described in Example 19. The result was the sliding surface thereof maintained normal sealing effect. On the contrary, in seat rings and driven rings which had not been subject to abovementioned heating treatment sliding surface for sealing became rough to the touch, the inner peripheral edge was injured and water leakage was observed in the oil chamber.

What I claim is:

1. A method of removing residual stress of a work comprising movably mounting said work on a vibrator, forcedly vibrating said work at a frequency below the natural frequency of said work, then releasing said work from said vibrator, thereby affording said work to be subject to free vibration.

2. A method of removing residual stress of a work as claimed in claim 1, wherein said work is movably mounted on a vibrator by means of resilient members.

3. A method of removing residual stress of a work as claimed in claim 2, wherein said work is vibrated in a vertical direction.

4. A method of removing residual stress of a work as claimed in claim 2, wherein said work is vibrated in a horizontal direction.

5. A method of removing residual stress of a work as claimed in claim 3, wherein said work is a ring.

6. A method of removing residual stress of a work as claimed in claim 3, wherein said work is plate-shaped.

7. A method of removing residual stress of a work as claimed in claim 1, wherein said work is formed of cemented carbide, carbon steel, steel, stainless steel or ceramic.

8. A method of removing residual stress of a work as claimed in claim 4, wherein said work is a ring.

9. A method of removing residual stress of a work as claimed in claim 4, wherein said work is plate-shaped.

10. A method of removing residual stress of a work as claimed in claim 3, wherein said work is formed of cemented carbide, carbon steel, steel, stainless steel, or ceramic.

11. A method of removing residual stress of a work as claimed in claim 4, wherein said work is formed of cemented carbide, carbon steel, steel, stainless steel, or ceramic.

12. A method forming a seal ring comprising forming a metal ring having a sealing face, machining the sealing face to provide a smooth surface thereto, and vibrating the sealing ring in direction perpendicular to the sealing face to remove internal stresses caused by the machining step.

13. The method of claim 12 in which the ring is formed for tungsten-carbide alloy and the machined ring is vibrated at a frequency within the range of 10Hz to 100Hz.

* * * * *